US006367906B1

(12) United States Patent
Hiramatsu et al.

(10) Patent No.: US 6,367,906 B1
(45) Date of Patent: Apr. 9, 2002

(54) INK JET RECORDING APPARATUS

(75) Inventors: Soichi Hiramatsu, Hachioji; Makoto Kashimura, Yokohama; Yuji Nakano, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/190,286

(22) Filed: Nov. 13, 1998

(30) Foreign Application Priority Data

| | | |
|---|---|---|
| Nov. 14, 1997 | (JP) | 9-313758 |
| Nov. 14, 1997 | (JP) | 9-313759 |
| Nov. 14, 1997 | (JP) | 9-313761 |
| Nov. 14, 1997 | (JP) | 9-313762 |

(51) Int. Cl.[7] ..... B41J 2/165
(52) U.S. Cl. ..... 347/34; 347/35
(58) Field of Search ..... 347/34, 37, 22, 347/18, 42, 13, 25, 35, 104

(56) References Cited

U.S. PATENT DOCUMENTS

| | | | | |
|---|---|---|---|---|
| 5,075,609 A | * | 12/1991 | Ito et al. | 347/37 |
| 5,296,873 A | * | 3/1994 | Russell et al. | 346/25 |
| 5,528,271 A | | 6/1996 | Ebisawa | 347/34 |
| 5,552,812 A | | 9/1996 | Ebinuma et al. | 347/34 |
| 5,748,206 A | * | 5/1998 | Yamane | 347/37 |
| 6,017,111 A | | 1/2000 | Kurata | 347/34 |

FOREIGN PATENT DOCUMENTS

| | | |
|---|---|---|
| EP | 568174 | 11/1993 |
| EP | 622243 | 11/1994 |
| EP | 0 694 403 | * 1/1996 |
| JP | 4-201452 | 7/1992 |
| JP | 8-217287 | 8/1996 |

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

An ink jet recording apparatus for recording onto a recording medium using an ink jet recording head which discharges ink, comprises a conveyor which conveys a recording medium, a mount for mounting an ink jet recording head, and an air flow generator. The air flow generator generates an air flow for transporting ink mist generated when ink is discharged from the ink jet recording head, floating in the inside of the ink jet recording apparatus and unused for recording. The head mount mounts the recording head such that ink is discharged toward a recording region located downward of the head mount, and is arranged forwardly of supporting members that support the head mount, and the air flow generator forms an air flow directed downwardly from above and forwardly of the supporting members.

20 Claims, 7 Drawing Sheets

INK JET RECORDING APPARATUS

BACKGROUND OF THE INVENTION

1. Field of the Invention

The present invention relates to an ink jet recording apparatus for discharging ink onto a recording medium to record thereon.

2. Related Background Art

In recent years, an ink jet recording apparatus for discharging ink onto a recording medium for forming an image or the like has been spectacularly pervasive for office and home use. The pervasion owes not only to an improvement in the recording speed and a reduction in price, but also to higher definition of a recorded image. In order to achieve the higher definition of the recorded image, a reduced diameter and higher density of ink discharging ports of an ink jet recording head are indispensable, and as the result, the size of ink droplets discharged therefrom has also been reduced.

However, the reduction in size of the ink droplets has given rise to a problem that, when ink is discharged, a minute ink particles called ink mist are generated, and the ink mist disperses and stains a recording medium and the inside of the recording apparatus. Further, when the ink mist dispersed in the recording apparatus deposits on a mechanism for recording operation in the recording apparatus, means for controlling therefor, or the like, malfunction may be caused. In order to prevent the malfunction, the recording apparatus may be provided with a suction fan to employ a method of collecting the dispersed ink mist making use of the suction fan. However, a periphery of the recording head where influence by adhesion and deposition of the ink mist is the largest, and a periphery of the conveying mechanism of the recording medium have insufficient space for providing the fan, and accordingly, in order to provide the fan, the space therefor is required to be newly secured, which has risen a problem that the whole body of the recording apparatus becomes unnecessarily large. Further, even if the fan is provided, the ink mist is hard to be efficiently collected, and the ink mist may be dispersed in the wrong way. The existing status of things is that the above mentioned problems are still left unsolved. Furthermore, when the fan is provided, a countermeasure for noise from the fan is required to be taken, and this is another factor for making the recording apparatus unnecessarily larger in size.

SUMMARY OF THE INVENTION

An object of the present invention is to provide an ink jet recording apparatus, which is excelled in reliability, and capable of recording an image in a stabilized way for an elongated period of time by eliminating staining of the inside of the recording apparatus, or preventing the deposition of the ink mist on parts where malfunction is liable to be caused by deposition of stains, using efficient control over a dispersing direction of ink mist generated by the discharge of ink.

Another object of the present invention is to provide an ink jet recording apparatus wherein, while a fan is provided for eliminating malfunction by the ink mist generated at the time of discharging ink, the whole body of the apparatus is refrained from being unnecessarily enlarged, and noise of the fan is suppressed.

A further object of the present invention is to provide an ink jet recording apparatus for recording onto a recording medium using an ink jet recording head which discharges ink. The ink jet recording apparatus comprises a conveying means for conveying a recording medium, a head mounting means for mounting an ink jet recording head, and an air flow generating means for generating an air flow for transporting ink generated by the ink discharged from the ink jet recording head, floating in the inside of the ink jet recording apparatus, and unused for recording; wherein the head mounting means is for mounting the recording head such that ink is discharged toward a recording region located downward of the head mounting means, and is arranged in the forward of supporting members provided to stand for supporting the head mounting means, and the air flow generating means forms an air flow from the above to downward in the forward of the supporting members.

A further object of the present invention is to provide an ink jet recording apparatus having a conveying means for conveying a recording medium, a carriage for mounting a recording head which discharges ink to record onto the recording medium, and an air flow control means for controlling, by an air flow, a flow of ink generated at the time when the recording head discharges ink, comprises a plate-shaped chassis supporting the carriage for mounting the recording head such that ink is discharged toward a recording region located downward of the carriage, and the chassis is disposed in the rear of the carriage, wherein the air flow control means forms an air flow directed from the above to the downward in the forward of the chassis.

A further object of the present invention is to provide an ink jet recording apparatus including a conveying means for conveying a recording medium, a carriage for reciprocally traveling a recording head which discharges ink to record onto the recording medium in a direction which crosses the recording medium conveying direction, and an air flow generating means for generating an air flow for controlling a flow of ink mist generated at the time when the recording head discharges ink, wherein the air flow generating means blows air toward a means for traveling the carriage.

A further object of the present invention is to provide an ink jet recording apparatus including a conveying means for conveying a recording medium, a carriage for reciprocally traveling a recording head which discharges ink to record onto the recording medium in a direction which crosses the recording medium conveying direction, and an air flow generating means for generating an air flow for controlling a flow of ink when ink is discharged from the recording head; and the air flow generating means blows air toward the carriage.

A further object of the present invention is to provide an ink jet recording apparatus including a conveying means for conveying a recording medium, a carriage for reciprocally traveling a recording head which discharges ink to record onto the recording medium in a direction which crosses the recording medium conveying direction, and an air flow generating means for generating an air flow for controlling a flow of ink mist generated at the time when the recording head discharges ink, wherein the air flow generating means blows air toward the carriage.

A further object of the present invention is to provide an ink jet recording apparatus including a conveying means for conveying a recording medium, a carriage for reciprocally traveling a record head which discharges ink to record onto the recording medium in a direction which crosses the recording medium conveying direction, and an air flow generating means for generating an air flow to control a flow of ink generated at the time when the recording head discharges ink, wherein said air flow generating means are provided such that an air flow is generated in the carriage traveling direction at the time when the recording head discharges ink.

A still further object of the present invention is to provide an ink jet recording apparatus including a conveying means for conveying a recording medium, a carriage for reciprocally traveling a recording head which discharges ink to record onto the recording medium in a direction which crosses the recording medium conveying direction, and an air flow generating means for generating an air flow to control a flow of ink generated at the time when the recording head discharges ink, wherein the air flow generating means has a blow fan for blowing air into a region where the carriage is traveled, and the blow fan is provided on the side of upstream relative to the carriage traveling direction at the time when the recording head discharges ink.

DETAILED DESCRIPTION OF THE PREFERRED EMBODIMENTS

Now, embodiments of the present invention will be described with reference to the drawings.

Figure 1:
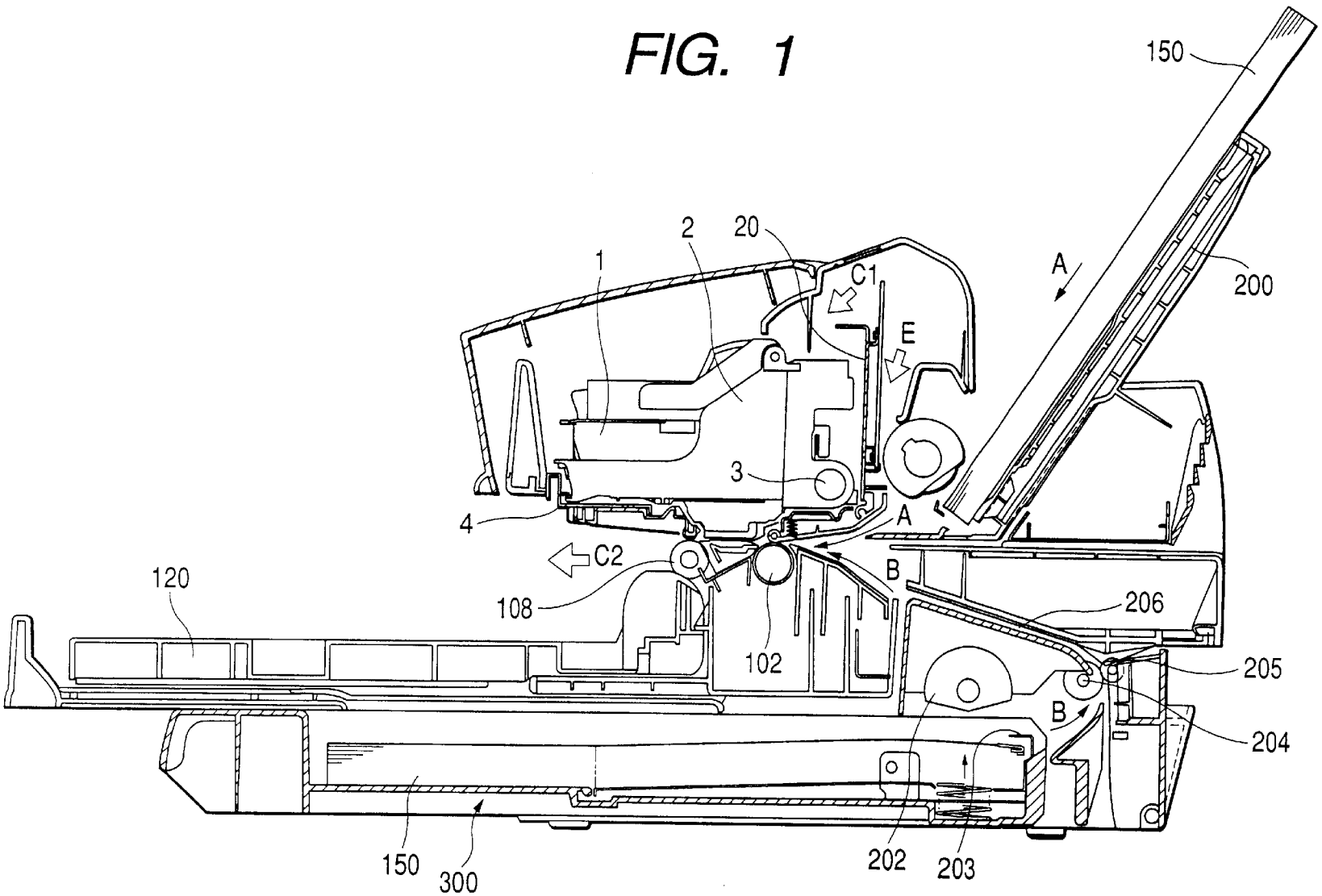
FIG. 1 is a schematic sectional view of an embodiment of the ink jet recording apparatus according to the present invention.

FIG. 1 is a schematic sectional view of an embodiment of the ink jet recording apparatus according to the present invention. The ink jet recording apparatus of the present embodiment is a serial type ink jet recording apparatus having a recording head 1 mounted on a carriage 2 which is reciprocally traveled in a direction different from the conveying direction of a recording medium, for example, to an orthogonal direction, for discharging ink from the recording head 1 while the recording head 1 is traveling to record on a recording medium, while alternately repeating a reciprocal traveling of the recording head 1 following to the traveling of the carriage 2 and a feeding of the recording medium at each predetermined pitch, and FIG. 1 is a sectional view cut at the middle of the width direction (traveling direction of the recording head 1) of the recording medium along the conveying direction of the recording medium.

Figure 2:
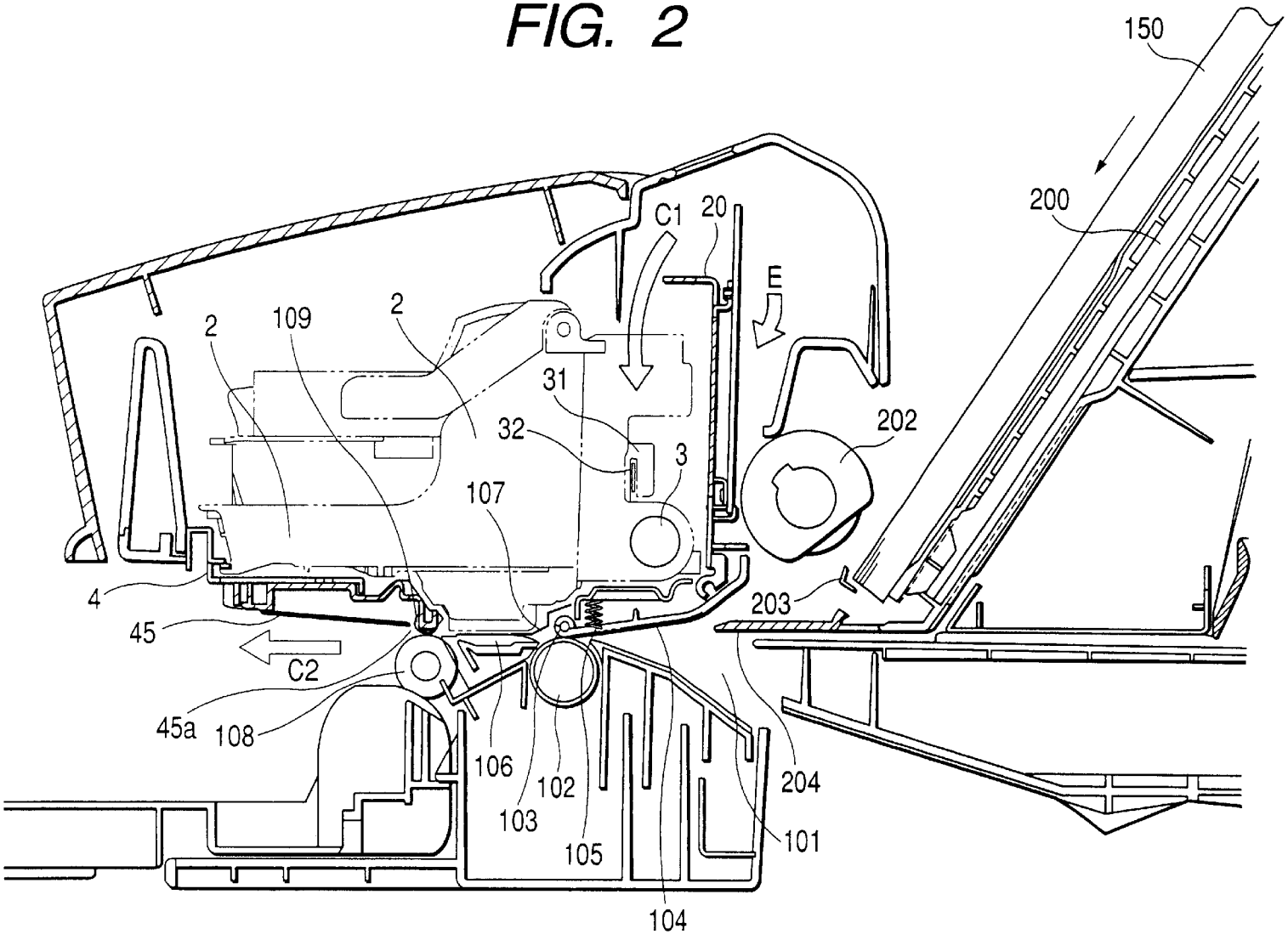
FIG. 2 is an enlarged sectional view of the surrounding of the recording section of the ink jet recording apparatus shown in FIG. 1.

And FIG. 2 is an enlarged sectional view of the surrounding of the recording section of the ink jet recording apparatus shown in FIG. 1. A description will be made hereunder of a mechanism pertinent to the recording motion of the ink jet recording apparatus according to the present embodiment with reference to FIGS. 1 and 2.

The carriage 2 is slidably held by a carriage shaft 3 and a guide rail 4 which are arranged and secured mutually in parallel on a plate-shaped chassis 20 which composes a base of the record motion mechanism of the ink jet recording apparatus. To the carriage 2, secured is a part of a timing belt (not shown) wounded around two pulleys (not shown) rotatably provided with an interval therebetween in the shaft direction of the carriage shaft 3, and by forward rotation and reverse rotation of a carriage driving motor (not shown), the carriage 2 is reciprocally traveled along the carriage shaft 3.

The recording head 1 has a plurality of discharging ports (not shown) for discharging ink, and is removably mounted on the carriage 2 with the discharging port surface, which is the surface where these discharging ports have openings, facing downward. Methods for making ink to be discharged from the discharging ports include broadly a method to provide thermal energy to the ink by a heater to utilize the change of state of the ink (generation of air bubble and the like) due to the thermal energy, and another method to provide mechanical energy to the ink by a piezoelectric element thereby to momentarily apply discharging pressure thereto, but in the present invention, the recording head of whichever the methods is applicable.

The recording head 1 and the carriage 2 mutually have an electrically connected section (head contact section) which are electrically connected, by having the recording head mounted on the carriage 2. To the recording head 1, a recording signal is fed from a control section on the side of the ink jet recording apparatus body via the electrically connected section, and based on the recording signal, thermal energy or mechanical energy is applied to the ink.

Further, on the chassis 20, a scale 32 is provided in an interval with the carriage 2 along the traveling direction of the carriage 2, and on the part of the carriage 2 facing to the chassis, a reading sensor 31 for reading the scale 32 is provided, and the scale 32 and the reading sensor 31 compose a linear encoder for detecting the position of the carriage 2 at a width direction of the recording medium.

As the linear encoder, an optical type or a magnetic type may be used, and for example, in a case of the optical type, the scale 32 is provided with a multiplicity of slits arranged in the traveling direction of the carriage 2 in a predetermined pitch, and as the reading sensor 31 an optical sensor is used. The position of the carriage 2 detected by the linear encoder is utilized for feed-back control of the above-mentioned carriage driving motor and control of ink discharging timing from the recording head 1. In other words, the linear encoder composes a means for traveling the carriage 2 together with the carriage shaft 3 holding the carriage 2.

Below the carriage 2, a carrier mechanism for conveying the recording medium is provided. In the present embodiment, the recording medium can be selectively conveyed from an auto sheet feeder 200 provided in the rear of the carriage 2, or a cassette 300 provided below the carriage 2.

The auto sheet feeder 200 holds a multiplicity of a recording paper 150 being the recording medium loaded thereon, and when a paper feeding roller 202 disposed at the down end of the recording paper 150 is rotated to touch the recording paper 150, the recording paper 150 is separated sheet by sheet by an action with a separating claw 203 to be conveyed in a direction indicated by an arrow A shown in FIG. 1. The separated recording paper 150 is led to a feeding path 101 by a recording paper direction regulating plate 204, and held between a conveying roller 102 driven by a paper feeding driving motor (not shown) and a pinch roller 103 which is rotatably held by a shaft on a pinch roller holding plate 104 urged toward the conveying roller 102 by an urging spring 105, and placed opposingly in relation to the conveying roller 102. When the paper feeding driving motor is driven here, the recording paper 150 is conveyed to a position below the recording head 1, namely to the position facing to the discharging port surface.

In the downstream of the conveying direction of the recording paper 150 by the conveying roller 102 and the pinch roller 103, a platen 106 is arranged facing with the discharging port surface of the recording head 1, and recording is performed on the platen 106 by discharging the ink from the recording head 1. On the platen 106, a paper pressing plate 107 formed by a plate member having rigidity is provided, and the recording paper 150 held between the conveying roller 102 and the pinch roller 103 is conveyed while being pressed by the platen 106 against the paper pressing plate 107. In this way, the recording paper 150 is prevented from being touched with the discharging port surface of the recording head 1, and an opposing distance between the recording paper 150 and the discharging port surface is kept constant to maintain at high accuracy the impinging position of the ink onto the recording paper 150.

The recording paper 150 conveyed over the platen 106 is further held between a paper expelling roller 108 arranged in downstream of the conveying direction and a spur 109, which is a rotary member for expelling paper on the other side, pressed to touch the paper expelling roller 108, and released on the paper expelling tray 120 to be stacked thereon. Although the spur 109 will be later described in detail, the spur 109 is provided in width direction in a plural number with an interval between the respective spurs.

The cassette 300 also holds a multiplicity of the recording paper 150 loaded thereon, and sheet by sheet separation of the recording paper 150 loaded on the cassette 300 is, similarly with the auto sheet feeder 200, performed by an action of the pickup roller 202 and the separation claw 203 to be conveyed to a direction indicated by an arrow B in FIG. 1. The recording paper 150 conveyed to the direction of the arrow B is held between the feeding roller 204 which is a driving roller, and a feeding roller 205 which is a subordinate roller pressed to touch the feeding roller 204, and led to the feeding path 101 through a cassette conveying path 206. As the conveying path and operation hereafter is similar to the auto sheet feeder 200, the description is omitted.

Besides, a chassis 20 aligns and holds the above described carriage shaft 3, the guide rail 4, the auto sheet feeder 200, the carriage driving motor, the paper feeding driving motor and the like, and rotatably holds the conveying roller 102 and the paper expelling roller 108.

Figure 3:
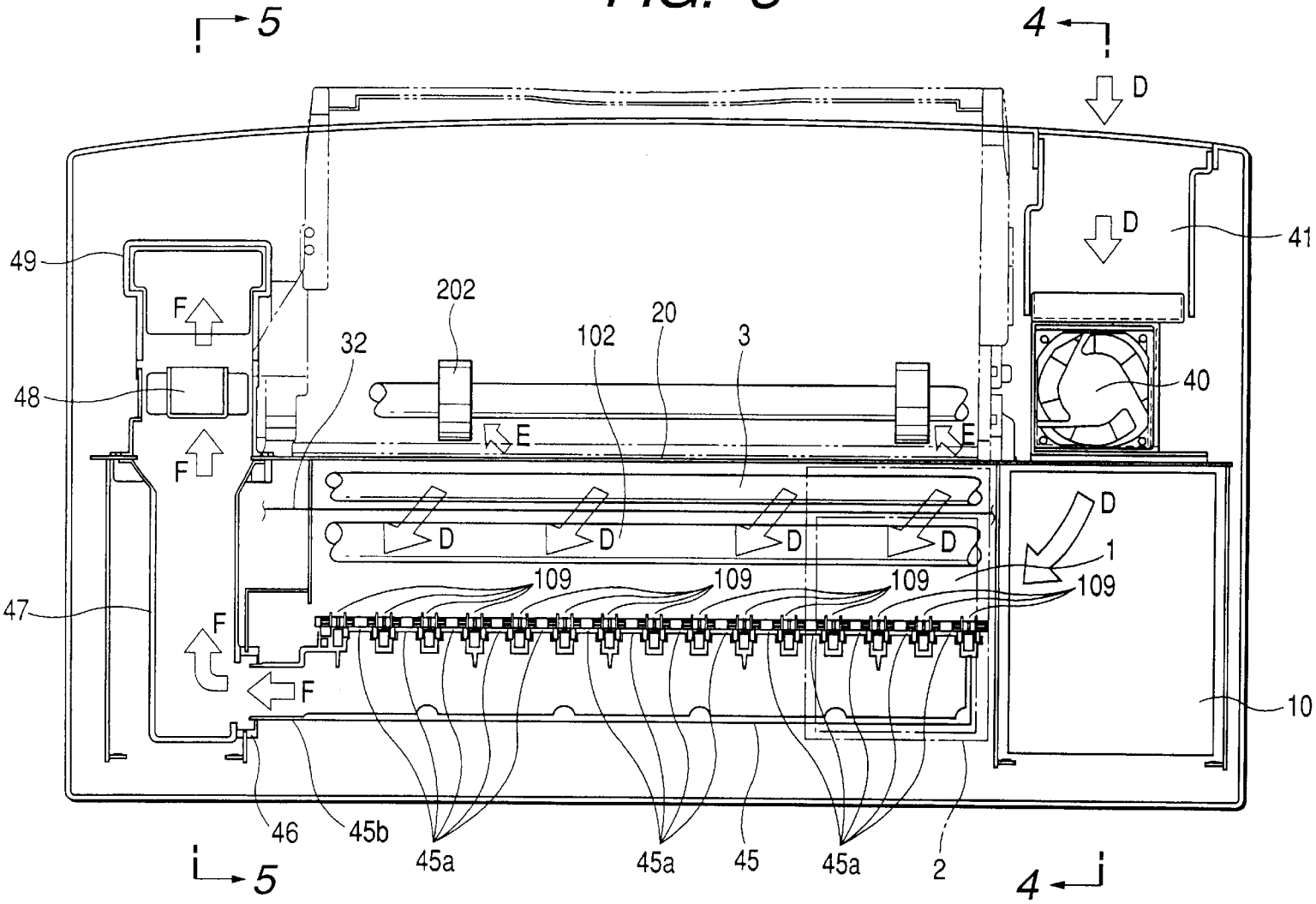
FIG. 3 is a sectional view taken horizontally across the ink jet recording apparatus shown in FIG. 1.

Further, as illustrated in the horizontal sectional view in FIG. 3, within the reciprocal traveling range and at the right outside edge of the region where the recording paper 150 passes, arranged is a head recovery system unit 10 provided with a sucking mechanism for forcibly sucking ink from the discharging port separately from the recording head 1 in order to maintain or recover the discharging function of the recording head 1, a wiping mechanism for wiping the discharging port surface in order to clean the discharging port surface of the recording head 1, a capping mechanism for tightly sealing the discharging port surface of the recording head in order to prevent dehydration of the ink in the discharging ports of the recording head 1 at non-recording time, and the like.

The recording head 1 is traveled to a position facing with the head recovery system unit 10 at non-recording time and at a constant time interval, and the predetermined recovery processing at this position such as a sucking operation by the sucking mechanism, a wiping operation by the wiping mechanism, or the like maintains the discharging characteristic in good condition. Moreover, the reference position (home position) of the recording motion by the recording head 1 is set at the end of the side where the head recovery system unit 10 of the recording region (a range where the carriage 2 is reciprocally traveled at the recording operation time) is provided, and based on the reference position, traveling of the carriage 2 for recording by the recording head 1 and traveling of the carriage 2 for recovery processing of the recording head 1 are controlled.

Further, in the present embodiment, the discharging operation of the ink from the recording head 1 is performed only when the recording head 1 is traveling from side of the reference position to the side of the non-reference position (in FIG. 3, from the right to the left). This is because, by always keeping constant the traveling direction of the recording head 1 at the time when the ink is discharged, the impinging accuracy of the ink onto the recording paper 150 is improved and a color image of high definition and high accuracy is enabled to be recorded.

In order to achieve an image of higher definition in the recording by the recording head 1, a smaller diameter and higher density of the discharging ports of the recording head 1 have been studied. As the result, the size of the discharging ink droplet is reduced, but following thereto, a multiplicity of minute ink particles (ink mist) are generated at the time of the ink discharging to disperse in the ink jet recording apparatus.

Figure 4:
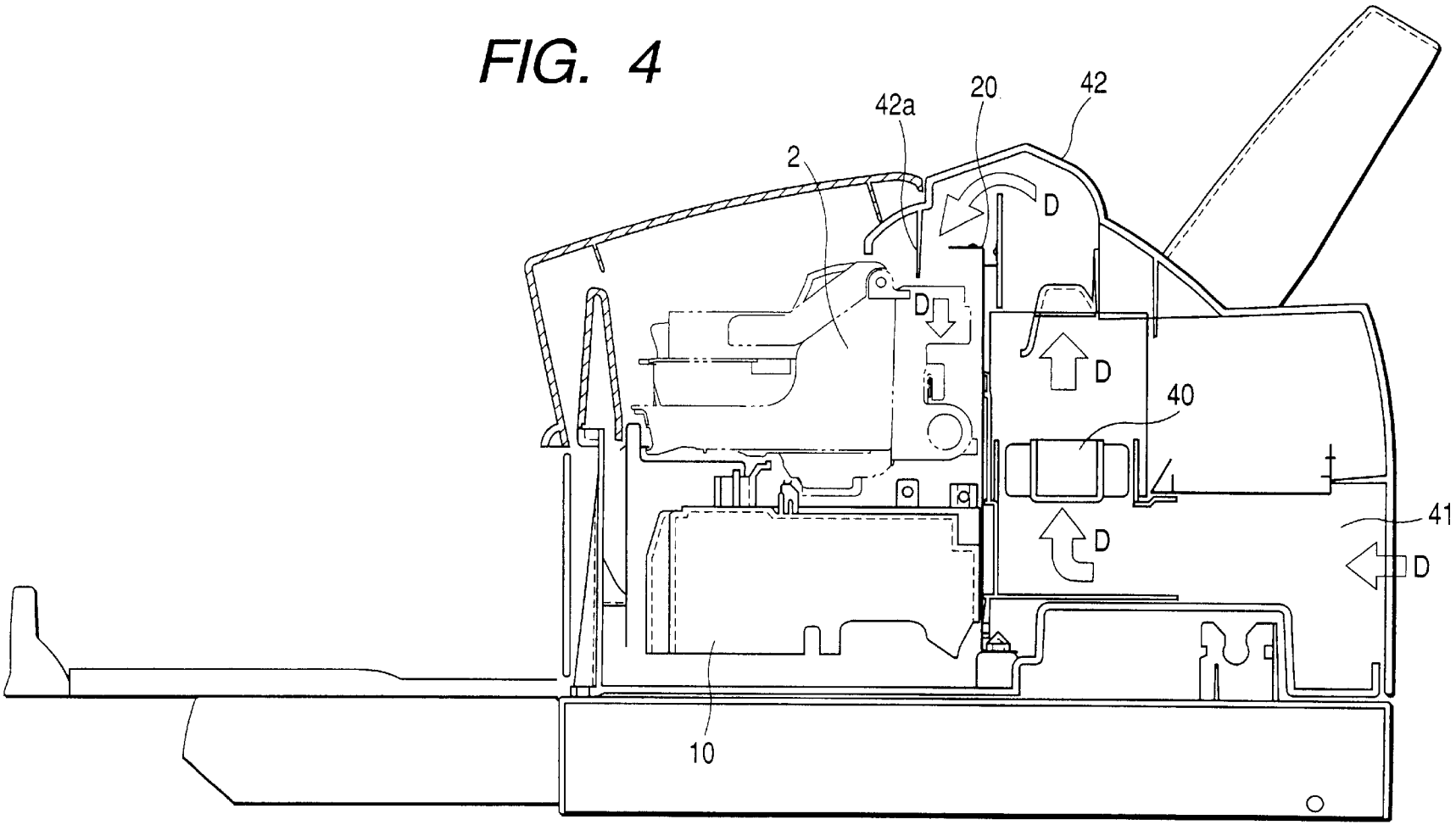
FIG. 4 is a sectional view taken along a line 4—4 of the ink jet recording apparatus shown in FIG. 3.
Figure 5:
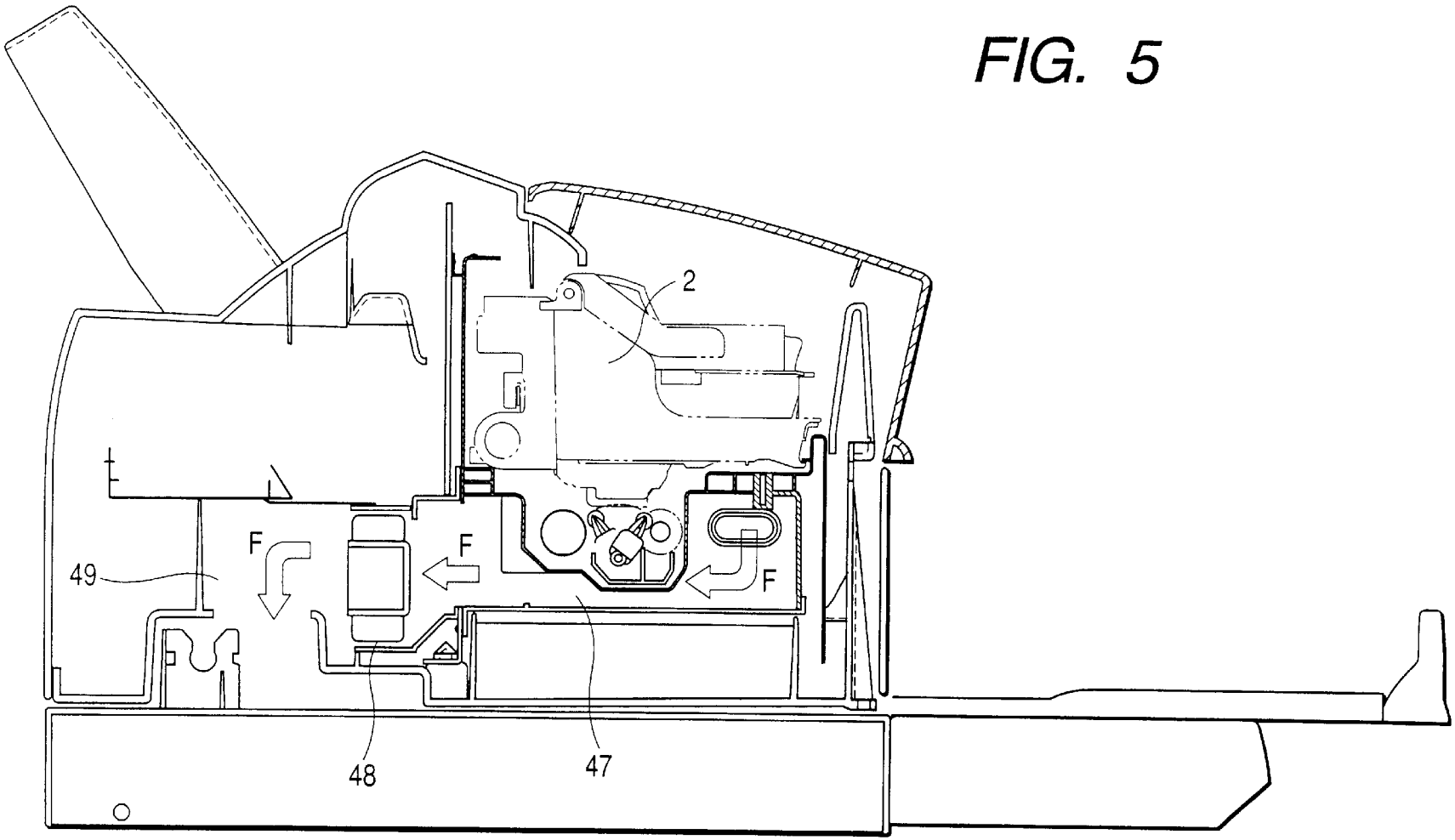
FIG. 5 is a sectional view taken along a line 5—5 of the ink jet recording apparatus shown in FIG. 3.

Thereupon, in the present embodiment, in order to efficiently control a flow of the ink mist, two fans comprising a blow fan 40 and a suction fan 48 are provided, as illustrated in FIG. 3, to form an air flow to be later described of the predetermined direction in the recording apparatus. The air flow by these blow fan 40 and suction fan 48 will be described hereunder with reference to FIG. 2 to FIG. 5. Besides, FIG. 4 is a sectional view taken along an 4—4 line of the ink jet recording apparatus illustrated in FIG. 3, and FIG. 5 is a sectional view taken along an 5—5 line of the ink jet recording apparatus illustrated in FIG. 3.

The blow fan 40 is for blowing air from the outside into the inside of the ink jet recording apparatus, and is positioned at the upstream of the carriage 2 relative to the conveying direction of the recording paper 150 and in the neighborhood of the head recovery system unit 10 in the side of the reference position relative to the traveling direction of the carriage 2. By the blow fan 40, within the region where the carriage 2 arranged in the inside of the ink jet recording apparatus is traveled, broadly speaking, formed is an air flow from the upstream to the downstream of the conveying direction of the recording paper 150. Owing to the air flow, the ink mist generated by the discharging of ink from the recording head 1 flows toward the expelling direction of the recording paper 150, and therefore, the ink mist can be efficiently controlled without being dispersed in the ink jet recording apparatus.

Figure 6:
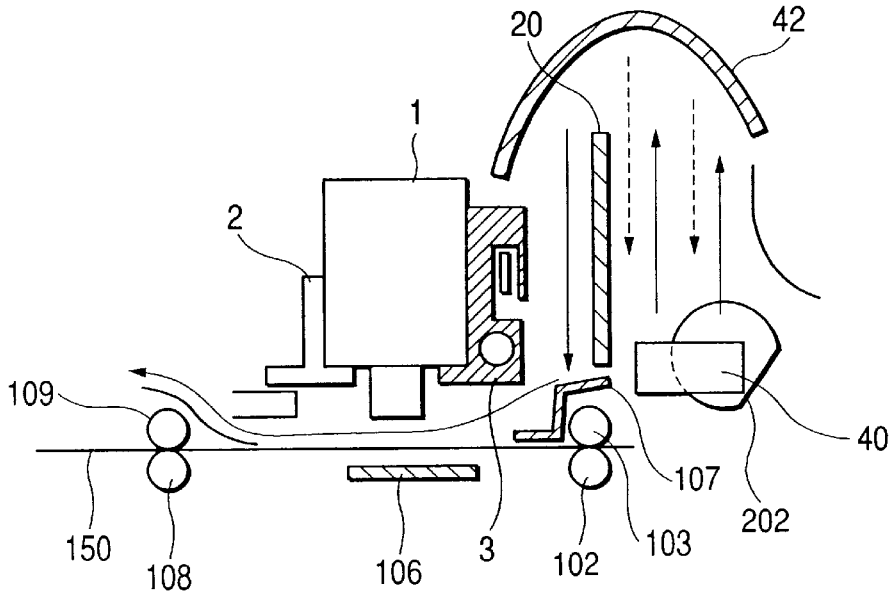
FIG. 6 is a diagram describing an outline of air flow route from upstream to downstream of the conveying direction of a recording paper, in the ink jet recording apparatus shown in FIG. 1 and others.

An outline of the air flow path from the upstream to the downstream of the conveying direction of the recording paper 150 will be described with reference to FIG. 6.

The air flow generated by the blow fan 40 at first impinges the back of the chassis 20 and flows upward along the chassis 20 to impinge a housing cover 42 covering an upper part of the chassis 20. A greater part of the air flow which impinges the housing cover 42 rides over the chassis 20 to flow forward, but a part of the air flow causes to generate a downward flow (the flow in a direction indicated by an arrow of a dotted line) on the back of the chassis 20 in the side of the above described non-reference position. The downward flow is blown to the paper feeding roller 202.

Meanwhile, the air flow which flows toward the forward of the chassis 20 flow downward along the shape of the housing cover 42, and passes through an interval between the carriage 2 and the chassis 20 to be blown onto the above described linear encoder, the carriage shaft 3, and the like. Further, the air flow impinges the paper pressing plate 107 which covers the conveying roller 102 and the pinch roller 103, where the flow direction is changed to a direction along the conveying direction of the recording paper 150, passes through an interval between the recording head 1 and the recording paper 150, more specifically, through a recording region, a region facing to the platen 106, and flows toward the paper expelling side having the paper expelling roller 108 and the spurs 109.

Besides, as above described, since the air flow generated by the blow fan 40 passes through the recording region, output of the blow fan 40 is made to be the output of a degree such that the air flow in the recording region is not powerful enough to affect a dispersing flight of the ink discharged from the recording head 1.

The air flow by the blow fan 40 will be described hereunder more in detail. As illustrated in FIG. 4, the blow fan 40 is arranged so as to blow out an air from the below to the above thereof, and forms a flow, as illustrated by an arrow D in FIG. 4, that sends upward the air taken in from the outside via an outside air intake duct 41.

As the chassis 20 exists between the blow fan 40 and the carriage 2, as illustrated in FIG. 4, the air blown out from the blow fan 40 is suspended from directly flowing into the side of the carriage 2, and impinges a ceiling part of an inner wall of the housing cover 42 covering the whole of the ink jet recording apparatus (chassis 20, carriage 2, conveying mechanism, and the like). The ceiling part forms a concave curved surface seen from the inside of the housing cover 42, and the air which impinges the ceiling part rides over the chassis 20, impinges an air flow regulating plate 42*a* formed in the inside of the package cover 42 facing downward, and flows downward toward the carriage 2.

In this way, by making the shape of the ceiling part of the housing cover 42 as a concave curved surface seen from the inside thereof, the air which impinges the ceiling part can effectively be led to the side of the carriage 2. Further, as the air flow generated at the blow fan 40 is led toward the side of the carriage 2 utilizing the housing cover 42, forming of a new path for the air flow is unnecessary, and the air flow at the rear of the chassis 20 can be led to the forward of the chassis 20 with a simple configuration.

Further, as the blow fan 40 is arranged on the side of the reference position of the recording head 1, and a space covered by the housing cover 42 has a larger space compared with the side of the reference position on the opposite side (the side of the non-reference position) of the reference position relative to the traveling direction of the recording head 1, the air which impinges the ceiling part of the housing cover 42 also flows from the side of the reference position to the side of the non-reference position, and when flowing downward toward the carriage 2, an air flow from the side of the reference position to the side of the non-reference position is formed together with an air flow to downward.

The air flow from the side of the reference position to the side of the non-reference position is formed, as indicated also by the arrows D in FIG. 3, across the whole region of the width direction of the recording paper 150. The air flow is, as indicated by an arrow C1 in FIG. 2, mostly directed more to the downstream of the conveying direction of the recording paper 150 than to the chassis 20, and partially, not overriding the chassis 20, directed downward as it is, as indicated by an arrow E in FIG. 2, at a position more upstream of the conveying direction of the recording paper 150 than the chassis 20.

The air flown in the direction of the arrow E is blown onto the paper feeding roller 202 of the auto sheet feeder 200 positioned at the rear of the chassis 20 (the upstream of the conveying direction of the recording paper). In this way, the dispersed ink mist is prevented from adhering to the paper feeding roller 202. As the result, when the recording paper 150 is separated sheet by sheet from the auto sheet feeder 200 by the paper feeding roller 202, the ink mist adhered to the paper feeding roller 202 can be prevented from being transferred to the recording paper 150, and the surface of the recording paper 150 can be avoided of being stained by the ink mist.

Meanwhile, the air flown in the direction indicated by the arrow C1 in FIG. 2, is blown to the carriage 2, the scale 32, the carriage shaft 3, and respective members for conveying the recording paper 150, namely the conveying roller 102, the pinch roller 103, the paper pressing plate 107, and the like.

As the conveying roller 102, the pinch roller 103, and the paper pressing plate 107 are subjected to air blowing, these members are prevented from being adhered to by the ink mist, and similarly with the case of the above described paper feeding roller 202, the recording paper 150 is prevented from being stained by the ink mist while the recording paper 150 is being conveyed. By the way, the pinch roller 103 is provided in a plural number in width direction of the recording paper 150 with a space between the respective rollers, and in the air flow path in this region, bumps are formed by respective pinch rollers 103. When air is blown onto the part where the pinch rollers 103 are thus arranged, the air flow gets turbulent, and the air flow from the side of the reference position to the side of the non-reference position and the air flow from the upstream to the downstream relative to the conveying direction of the recording paper 150 are obstructed. Thereupon, in the present embodiment, the paper pressing plate 107 is made in a shape that covers all the pinch rollers 103 so that the bumps due to the pinch rollers 103 are eliminated so as to create an efficient air flow.

Further, as the carriage shaft 3 is subjected to air blowing, the carriage shaft 3 is prevented from ink mist being adhered thereto, and an increase in sliding load on the carriage 2 due to the adhesion of the ink mist to the carriage shaft 3 is prevented. Furthermore, as the scale 32 is subjected to air blowing, adhesion of the ink mist to the scale 32 is prevented, and faulty reading of the scale 32 by the reading sensor 31 may be prevented. As the adhesion of the ink mist to the carriage shaft 3 and the scale 32 is prevented in this way, stabilized operation and reliable position control of the carriage 2 become possible.

The air blown onto the carriage 2 is blown to the electrically connected section (head contact section) between the recording head 1 and the carriage 2, the reading sensor 31, and the discharging port surface of the recording head 1, and then flows through respective spurs 109 to the paper expelling side of the recording paper 150 as indicated by an arrow C2 in FIG. 2. Thus, adhesion of the ink mist to the head contact section, reading sensor 31, and the discharging port surface is prevented. Further, as the adhesion of the ink mist to the discharging port surface of the recording head 1 is prevented, faulty discharging of ink due to wetting, soiling, or the like of the discharging port surface is prevented. Furthermore, as the adhesion of the ink mist to the head contact section is prevented, electrical faulty connection between the recording head 1 and the carriage 2 is prevented. Further, as the adhesion of the ink mist to the reading sensor 31 is prevented, faulty position detection of the carriage 2 is prevented, and resultantly maloperation of the carriage 2 can be prevented.

Moreover, the air flown in a direction as indicated by the arrow C1 in FIG. 2 is also blown onto the head recovery system unit 10, as illustrated in FIG. 3. The recording head 1, at a position opposing to the head recovery system unit 10, prior to the recording operation, or at each fixed timing, performs a preliminary discharge for discharging thickened ink in the recording head 1, minute dust, and the like, and at this instance, ink mist is also generated. When the head recovery system unit 10 is subjected to air blowing, the ink mist generated at the time of preliminary discharge escapes to a direction indicated by the arrow C2 in FIG. 2, and the adhesion of the ink mist to the capping mechanism and the wiping mechanism provided in the head recovery system unit 10 is prevented, thus deterioration of the discharging characteristic of the recording head 1 can be prevented.

Moreover, as previously described, since the discharge of the ink from the recording head 1 is performed only when the carriage 2 is traveling from the side of the reference position to the side of the non-reference position, the air flow from the side of the reference position to the side of the non-reference position, as shown by an arrow D in FIG. 3, can efficiently control the ink mist generated at the time when the ink is discharged from the recording head 1.

In other words, when the carriage 2 travels from the side of the reference position to the side of the non-reference position, negative pressure is generated at the rear of the traveling direction of the carriage 2. Although the negative pressure causes to generate an air flow which is in a direction reverse to the direction of the arrow C2 in FIG. 2, namely an air flow directing from the outside of the ink jet recording apparatus to the inside of the reciprocal traveling region of the carriage 2, an air flow along the traveling direction of the carriage 2 exists in the reciprocal traveling region of the carriage 2, and the air flow negates the air flow of the direction reverse to the direction of the arrow C2, thereby the ink mist is prevented from being dispersed in the inside of the ink jet recording apparatus.

Further, as an air flow by the blow fan 40 is to be created by air introduced from the outside of the ink jet recording apparatus, fresh air is introduced into the inside of the ink jet recording apparatus. As the result, the ink mist generated in the ink jet recording apparatus ceases to circulate in the ink jet recording apparatus, and adhesion of the ink mist to the above described respective members may more effectively be prevented.

As described heretofore, the air flow generated by the blow fan 40 proceeds, in the end, through an interval between the paper feeding roller 108 and the spurs 109 to the direction indicated by the arrow C2 in FIG. 2.

Figure 7:
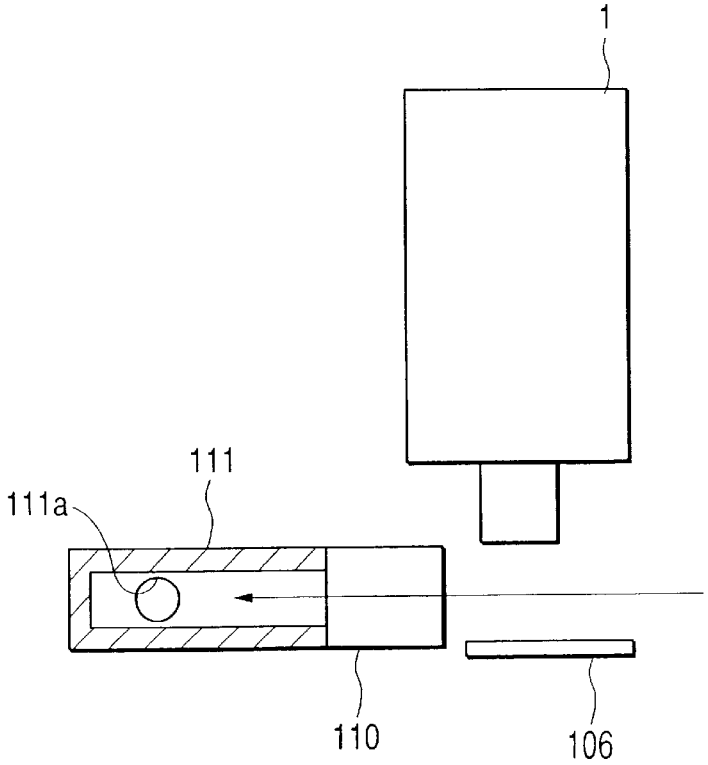
FIG. 7 is diagram describing an outline of an air flow sucked from a recording region, in the ink jet recording apparatus shown in FIG. 1 and others.

The air flow proceeding toward the direction of the arrow C2 is absorbed by the air flow generated from the suction fan 48. The outline of the air flow will be described with reference to FIG. 7.

On the downstream side relative to the conveying direction of the recording paper in the recording region, a region where the recording head 1 and a platen 106 opposes each other, a paper expelling unit 110 and an ink mist collecting path forming member 111 having a space for containing the ink mist are provided. In the ink mist collecting path forming member 111, the spurs 109, which is a rotary members for discharging paper and compose a paper expelling unit 110 (refer FIG. 2 and others), are removably provided. Moreover, in the ink mist collecting path forming member 111, provided is a joint section 111*a* removably connected with a duct where the suction fan 48 (refer FIG. 3 and others) is provided, as later described. Because of this, air in the recording region is to be sucked via the paper expelling unit 110 and the ink mist collecting path forming member 111. Moreover, the ink mist collecting path forming member 111 and the paper expelling unit 110 can be replaced as an integrated body or individually.

The air flow and the air sucking path by the above mentioned suction fan 48 will be described in detail hereunder. As illustrated in FIGS. 2 and 3, of the conveying mechanism of the recording paper 150, the spurs 109 positioned at the dead end downstream of the conveying direction of the recording paper 150 are provided in plurality with a space between the respective spurs in width direction of the recording paper 150, in a box-type spur base 45 having substantially the same width as the recording paper 150. Respective spurs 109 are arranged at the upstream end of the spur base 45 relative to the conveying direction of the recording paper 150, and on a low wall of the spur base 45, suction ports 45*a* are formed respectively between and in the neighborhood of the respective spurs 109.

The spur base 45 is one component of a replacement unit which is regularly replaced for maintenance of the ink jet recording apparatus. Therefore, in the width direction of the spur base 45, and at the end of the opposite side relative to the head recovery system unit 10 (the end of the side of the non-reference position), a joint section 45*b* is provided as a body, and the joint section 45*b* is removably connected with a relay duct 47 via a rubber joint 46 having a sealing function. Although the tip of the relay duct 47 is secured to the chassis 20, at the point of the chassis 20 where the relay duct 47 is secured, an aperture corresponding to the cross sectional shape of the relay duct 47 is provided, and at the aperture, the suction fan 48 for expelling the air in the spur base 45 via the relay duct 47 is provided. In other words, the suction fan 48 is arranged on the back of the chassis 20.

By providing the suction fan 48 and the blow fan 40 on the back (rear) of the chassis 20 in this way, as driving noise of the suction fan 48 and the blow fan 40 is blocked by the chassis 20, noise toward the forward of the ink jet recording apparatus can be reduced. Furthermore, as complicated mechanism needed to be positioned on the back of the chassis 20 is small in number, a large space can be secured thereat, and a blow fan 30 and a suction fan 48 can be provided without unnecessarily enlarging the size of the ink jet recording apparatus.

Further, on the expelling side of the suction fan 48, a suction fan duct 49 is provided, which leads the air released from the suction fan 48 downward, as illustrated in FIG. 5.

In this way, the air flowing through respective spurs 109 to the direction of the arrow C2 is, as indicated by an arrow F in FIGS. 3 and 5, sucked from respective suction ports 45*a* into the spur base 45, and released from the back of the ink jet recording apparatus through the relay duct 47.

Although the air flowing in the direction indicated by the arrow C2 in FIG. 2 contains ink mist, recording is completed while the air flowing in the direction of the arrow C2, namely toward the conveying direction of the recording paper 150, is being sucked and adhesion of the ink mist to the recording paper 150 released on a paper expelling tray 120 is prevented. Moreover, by providing the suction ports 45*a* between the respective spurs 109, the ink mist can be sucked at a position nearer to the recording head 1 which generates the ink mist, thus the ink mist can be efficiently sucked. Further, when the suction fan 48 is positioned on the side of the non-reference position, and the connecting section with the relay duct 47 is provided on the side of the non-reference position, an air flow from the side of the reference position toward the side of the non-reference position is created in the spur base 45, thus the air flow from the side of the reference position toward the side of the non-reference position in the traveling region of the carriage 2 is immune from obstruction.

Respective suction ports 45*a* are arranged, as illustrated in FIG. 3, such that the ports positioned on the upstream side of the air flow direction in the spur base 45 is to have a larger aperture area than the ports positioned on the downstream side thereof. By this arrangement, a sufficient air sucking force relative to the air flow in the spur base 45 is generated also on the upstream side, and the path resistance in the spur base 45 may be made substantially uniform in the width direction of the spur base 45, thus the air flow in the spur base 45 is kept substantially uniform. As the result, the ink mist is efficiently sucked across the whole region of the width direction of the recording paper 150.

Moreover, by enlarging the aperture area of the suction ports 45*a* in the upstream of the air flow in the spur base 45, namely on the side of the head recovery system unit 10, the ink mist generated at recovery processing of the recording head 1 may be efficiently sucked, and the ink mist may be prevented from dispersing to the important members such as the capping mechanism and the wiping mechanism of the head recovery system unit 10.

Moreover, as the spur base 45 is removably provided on the ink jet recording apparatus by the joint section 45*b*, when the ink jet recording apparatus is used for an elongated time, ink mist sucking performance of the suction ports 45*a* is deteriorated by the ink mist deposited in the inside of the spur base 45, or the ink mist is deposited on the spurs 109 to cause stains to be transferred onto the recording paper 150, the spur base 45 may be easily dismounted for cleaning and replacement thereof. Furthermore, the spur base 45 may be mounted or dismounted only by inserting or drawing the joint section 45*b* into or out of the rubber joint 46, the mounting or dismounting of the spur base 45 may be surely performed with ease. By providing in this way a sucking path for the air mixed with the ink mist in the spur base 45, which is a component of the replacement unit, the ink jet recording apparatus may be simultaneously subjected to regular maintenance and removed of the ink mist adhered to the inside of the sucking path. By such arrangement, the ink mist dispersed in the ink jet recording apparatus may be efficiently sucked even without deteriorating the ink mist sucking efficiency throughout the sucking path.

As the diameters of the ink mist particles are very minute, a greater part of the ink mist sucked from the suction ports 45*a* of the spur base 45 adheres to the inner wall surface of the spur base 45 or the relay duct 47, and the ink mist seldom escapes from the ink jet recording apparatus to the outside, but when the ink jet recording apparatus is used for an elongated time, the ink mist escaped to the outside of the ink jet recording apparatus, although very minutely at a time, may be deposited to cause staining of the outside of the ink jet recording apparatus. Thereupon, by providing a filter for picking up the ink mist at the inside of at least either of the relay duct 47 or a suction fan duct 49, the escape of the ink mist to the outside of the ink jet recording apparatus may assuredly be prevented.

Figure 8:
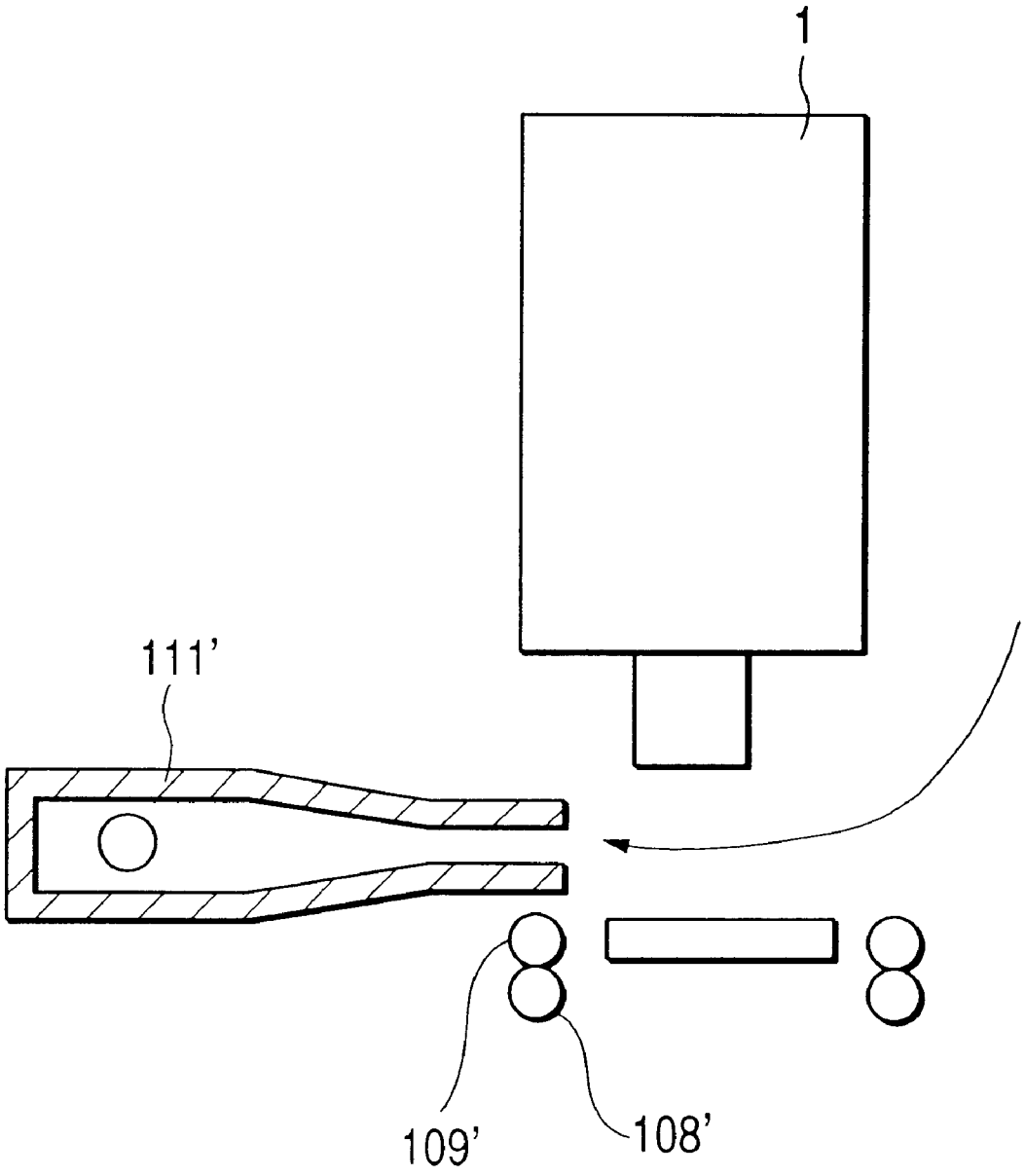
FIG. 8 is a diagram describing an outline of an air flow sucked from the recording region, in a case where a member containing ink mist is arranged separately from paper expelling means.

In the present embodiment above described, although a description is made about a case of configuration where ink mist containment members and the paper expelling unit are replaceable, the ink mist collecting path forming member 111' may be provided separately from the spurs 109' and the paper expelling roller 108', making only the ink mist collecting path forming member 111' replaceable, as illustrated in FIG. 8.

Further, although an example where the blow fan 40 and the suction fan 48 are used as air flow generating means is given, in a case where the air flow generated in the reciprocal traveling region of the carriage 2 is sufficient only with the air flow from the upstream to the downstream relative to the conveying direction of the recording paper 150, either of the blow fan 40 or the suction fan 48 may be used.

Furthermore, in the above, a description is made about a case where the ink discharge from the recording head 1 is performed while the carriage 2 travels from the side of the reference position to the side of the non-reference position (one-way recording), even when the recording is performed while the carriage 2 travels from the side of the non-reference position to the side of the reference position (two-way recording), substantially similar advantage is expected, as an air flow is formed from upstream to downstream of the conveying direction of the recording medium. Further, although the above description is made about the serial type ink jet recording apparatus, an ink jet recording apparatus using a line type recording head may achieve substantially similar advantage due to the same reason.

The ink jet recording apparatus as above described, when having an air flow generating means for generating an air flow directed from the upstream to the downstream relative to the recording medium conveying direction, can efficiently direct the ink mist generated by the discharge of ink from the recording head toward the recording medium expelling direction. As the result, ink mist is eliminated from being dispersed into the various kinds of mechanisms necessary for recording, particularly into a region where recording is performed, and the sections are prevented from being stained by ink mist and further from ink mist being deposited thereon, thus an ink jet recording apparatus which is excelled in reliability and capable of recording a high definition image for an elongated period of time can be provided.

Air flow generating means can be preferably provided both of a blow fan for blowing air from a position further upstream of the recording head relative to the recording medium conveying direction and a suction fan for sucking air from a position further downstream to the recording head relative to the recording medium conveying direction, but an arrangement is possible to use at least either one of the fans described herein.

In a case where a suction fan is used as the air flow generating means, an air sucking path having a plurality of apertured air sucking ports along the carriage traveling direction is provided in a position further downstream relative to the recording medium conveying direction, and by connecting the air sucking path with the suction fan, the air flown further downstream to the recording head relative to the recording medium conveying direction is efficiently sucked from the air sucking ports. Particularly, in this case, when aperture area of the air sucking ports located remote from the connecting section with the suction fan of the air sucking path is made larger with the air sucking ports than aperture area of the air sucking ports located close to the connecting section, sufficient air sucking power is generated even at the sucking ports remote from the sucking fan, and ink mist is efficiently sucked along the reciprocal traveling direction of the carriage.

Further, the air flow generated at the air flow generation driving section is formed in the forward of the chassis via the path. In the forward of the chassis, the carriage mounting the recording head and the conveying means are arranged, and ink mist generated by the discharge of ink from the recording head is blown to the outside of the recording apparatus by the air flow formed in the forward of the chassis, or collected. Here, as the air flow generation driving section is provided in the rear of the chassis where the carriage and the conveying means are not provided, the air flow generation driving section can be provided in a size necessary for blowing or collecting the ink mist. Further, as the air flow generation driving section is provided in the rear of the chassis, the air flow for preventing ink mist adhesion can be controlled without unnecessarily enlarging the size of the ink jet recording apparatus, and moreover, noise due to the driving sounds of the air flow generation driving section in the forward of the chassis can be suppressed.

Further, by forming an air flow path making use of a housing cover covering the above of the air flow generation driving section, the chassis, and the carriage, a path can be formed in simple configuration. Particularly, by making the housing cover in structure having a ceiling part in a shape of concave curved surface seen from the inside, the air flow in the rear of the chassis can be efficiently led to the forward of the chassis.

Furthermore, by an air flow generating means, air is blown toward the conveying means for conveying the recording medium, thereby the conveying means is prevented from being adhered to by ink mist, and the ink mist is eliminated from being transferred from the conveying means to the printing medium, with the result that the recording medium is prevented from being stained and an ink jet recording apparatus which is excelled in reliability and capable of recording a high definition image for an elongated period of time can be provided. The conveying means includes supply members for supplying the recording medium into the region where the carriage is reciprocally traveled, conveyor members for conveying the recording medium to a position which faces the ink discharging surface of the recording head, and guide members for guiding the recording medium conveyed toward the recording head such that the opposing distance with the ink discharging surface of the recording head is constant.

Further, the air flow generating means blows air toward a means for traveling the carriage, thereby the means for traveling the carriage is prevented from ink mist adhesion, enabling stabilized operation of the carriage, and an ink jet recording apparatus which is excelled in reliability and capable of recording a high definition image for an elongated period of time can be provided. The means for traveling the carriage includes shaft members for slidably guide the carriage toward the traveling direction thereof, and a carriage position detecting means for detecting the position of the carriage.

Further, the air flow generating means blow air toward the carriage, thereby ink mist is prevented from adhering to the structure members of the carriage and the recording head mounted on the carriage. In the ink jet recording apparatus, the recording head is an important part related to the discharge of ink, and by the structure members of the carriage and the recording head being prevented from adhesion of ink mist, stabilized discharge of ink becomes possible, and an ink jet recording apparatus which is excelled in reliability and capable of recording a high definition image for an elongated period of time can be provided.

Further, fresh air introduced from the outside via the air introduction members are blown by the blow fan into a region where the carriage is reciprocally traveled. The air blown by the blow fan excludes ink mist generated by the discharge of ink from the recording head to the outside of the region where the carriage is reciprocally traveled. By excluding the ink mist by blowing fresh air thereto in this way, adhesion of ink mist is more efficiently prevented inside the region where the carriage is reciprocally traveled, and an ink jet recording apparatus which is excelled in reliability and capable of recording a high definition image for an elongated period of time can be provided.

Further, the above described ink jet recording apparatus performs recording onto the recording medium with ink discharged from the recording head while the carriage is traveling, but by the travel of the carriage, negative pressure is generated in the rear of the carriage traveling direction. Therefore, ink mist generated by the discharge of the ink from the recording head is sucked into the carriage traveling region. Here, as the air flow generating means generates an air flow in the carriage traveling direction, the air flow directed toward the inside of the carriage traveling region is negated by the air flow generated by the air flow generating means, with a result that the ink mist is prevented from being dispersed into the carriage traveling region. As the result, an ink jet recording apparatus which is excelled in reliability and capable of recording a high definition image for an elongated period of time can be provided.

Further, in order to improve the accuracy of ink impinging onto the recording medium, when one end of the carriage reciprocal traveling region at the time when the recording head discharges ink is made as the reference position, ink may be arranged to discharge from the recording head while the carriage is traveling from the reference position toward the other end. In this case, as an air flow generating means, a blow fan for blowing air into a region where the carriage is traveled is used, and by providing the blow fan on the side of the above mentioned reference position, the air flow toward the carriage traveling direction at the time when the above mentioned recording head discharges ink is easily provided. Accordingly, in this case, a head recovery unit for performing recovery processing on the recording head is provided on the side of the above mentioned reference position in order to maintain the discharge characteristic of the recording head, and the air is disposed to blow to the head recovery unit to prevent adhesion of ink mist to the head recovery unit which is important in maintaining the recording head. As the result, an ink jet recording apparatus which is excelled in reliability and capable of recording a high definition image for an elongated period of time can be provided.

Further, as an air flow generating means, in addition to the above mentioned blow fan, a suction fan for sucking air from the side further downstream of the recording head relative to the recording medium conveying direction is used so that ink mist generated by the discharge of ink from the recording head is sucked by the suction fan, and the dispersion of ink in the carriage traveling region is more effectively prevented. In particular, on the side further downstream of the recording head relative to the recording medium conveying direction, an air sucking path having a plurality of apertured air sucking ports along the carriage traveling direction is provided, and the above mentioned suction fan is connected with the air sucking path at the end of the side downstream relative to the carriage traveling direction, thus the air is sucked from the sucking path, without blocking the flow of the air generated by the blow fan. In this case, by enlarging the aperture area of the air sucking ports located close to the reference position than that located remote to the reference position, the air flow in the sucking path is maintained substantially constant. As the result, an ink jet recording apparatus which is excelled in reliability and capable of recording a high definition image for an elongated period of time can be provided.

Furthermore, when a blow fan as an air flow generating means is provided on the side upstream relative to the carriage traveling direction at the time when the recording head discharges ink, air can be directly blown to ink mist generated by the discharge of ink from the recording head. As the result, ink mist can be efficiently discharged from a periphery of the recording head, and the ink mist is prevented from dispersing in the periphery of the recording head. Resultantly, an ink jet recording apparatus which is excelled in reliability and capable of recording a high definition image for an elongated period of time can be provided.

What is claimed is:

1. An ink jet recording apparatus for recording onto a recording medium using an ink jet recording head which discharges ink, comprising:

conveying means for conveying a recording medium;

head mounting means for mounting the ink jet recording head; and air flow generating means for generating an air flow for transporting ink mist generated by ink discharged from the ink jet recording head, the ink mist floating in an inside of said ink jet recording apparatus and unused for recording;

wherein said head mounting means is for mounting the ink jet recording head such that ink is discharged toward a recording region located downwardly of said head mounting means, and is arranged forwardly of supporting means provided to support said head mounting means, and wherein said air flow generating means defines an air flow directed from a rear to a front of said supporting means and from above to below beyond said supporting means.

2. An ink jet recording apparatus according to claim 1, wherein said ink jet recording head discharges ink using thermal energy obtained from a heater.

3. An ink jet recording apparatus according to claim 1, wherein said ink jet recording head discharges ink using mechanical energy obtained from a piezoelectric element.

4. An ink jet recording apparatus according to claim 1, wherein said head mounting means is reciprocally driven by drive means in a direction which crosses a conveyance direction of said conveying means, and wherein said air flow generating means blows air toward the drive means.

5. An ink jet recording apparatus according to claim 4, wherein said drive means has shaft members which slidably guide said mounting means in a traveling direction thereof.

6. An ink jet recording apparatus according to claim 4, wherein said drive means has position detecting means for detecting a position of said mounting means.

7. An ink jet recording apparatus according to claim 1, wherein said head mounting means is reciprocally driven along a carriage in a director which crosses a conveyance director of said conveying means, and wherein said air flow generating means blows air toward said carriage.

8. An ink jet recording apparatus according to claim 7, wherein said air flow generating means blows air toward an electrically connected section connecting said carriage and said recording head.

9. An ink jet recording apparatus according to claim 7, wherein said air flow generating means blows air toward said recording head carried on said carriage.

10. An ink jet recording apparatus according to claim 9, wherein said air flow generating means blows air toward an ink discharging surface of said recording head.

11. An ink jet recording apparatus according to claim 1, wherein said head mounting means is reciprocally driven along a carriage in a director which crosses a conveyance director of said conveying means, and wherein said air flow generating means has a blow fan for blowing air into a region where said head mounting means is reciprocally driven, and said blow fan is provided on an upstream side relative to a direction of travel at a time when said recording head discharges ink.

12. An apparatus according to claim 1, wherein said supporting means is provided on a side with respect to a moving direction of said head mounting means.

13. An ink jet recording apparatus having conveying means for conveying a recording medium, a carriage for mounting a recording head which discharges ink to record onto said recording medium, and air flow control means for controlling an air flow for a flow of ink generated upon an ink discharge from said recording head comprising:

a plate-shaped chassis supporting said carriage for mounting said recording head such that ink is discharged toward a recording region located downwardly of said carriage, said chassis being disposed rearwardly of said carriage;

wherein said air flow control means form an air flow directed downwardly from above and forwardly of said chassis.

14. An ink jet recording apparatus according to claim 13, further comprising an air flow generation section, and wherein an air flow path is formed by a housing cover covering a top of said air flow generation section, said chassis, and said carriage.

15. An ink jet recording apparatus according to claim 14, wherein said housing cover has a ceiling part in a shape of a concave curved surface seen from an inside thereof.

16. An ink jet recording apparatus according to any one of claims 14 or 15, wherein said air flow generation section has a blow fan for blowing air forwardly from the rear of said chassis, and a suction fan for sucking air rearwardly from the forward of said chassis; and said air flow path has an air blowing path for leading an air flow generated by said blowing fan to the forward of said chassis, and an air sucking path connected with said sucking fan arranged in the forward of said chassis.

17. An apparatus according to claim 13, wherein said plate-shaped chassis supporting members is provided on a side with respect to a moving direction of said carriage.

18. An ink jet recording apparatus, comprising:

conveying means for conveying a recording medium in a conveying direction;

a carriage for reciprocally moving a recording head which discharges ink to record onto said recording medium in a direction which crosses said recording medium conveying direction;

a blow fan for generating an air flow to control an ink mist generated when said recording head discharges ink, said blow fan being provided at a reference position side on an end of a reciprocal moving range of said carriage;

a suction fan for sucking air from downstream of the recording medium conveying direction with respect to the recording head; and an air exhausting route for sucking the air flow from downstream of the recording medium conveying direction with respect to the recording head to an end opposite to the reference position of the reciprocal moving range, and guiding the air flow to said suction fan, wherein said recording head discharges ink to record on the recording medium when said recording head moves from the reference position to the opposite end.

19. An ink jet recording apparatus according to claim 10, wherein a head recovery unit for performing recovery processing on said recording head in order to maintain discharging characteristic of said recording head is provided on the side of said reference position, and said blow fan blows air also to said head recovery unit.

20. An ink jet recording apparatus according to claim 18, wherein said air exhausting route comprises a plurality of air suction ports provided along a region in which said carriage is reciprocally driven, and an aperture area of said air suction ports located close to said reference position is larger than an aperture area of said air suction ports located remotely from said reference position.

* * * * *

UNITED STATES PATENT AND TRADEMARK OFFICE

CERTIFICATE OF CORRECTION

PATENT NO. : 6,367,906 B1
DATED : April 9, 2002
INVENTOR(S) : Soichi Hiramatsu et al.

It is certified that error appears in the above-identified patent and that said Letters Patent is hereby corrected as shown below:

Column 1,
Line 21, “a” (second occurrence) should be deleted;
Line 37, “risen” should read -- raised --.

Column 2,
Line 45, “head; and” should read -- head, wherein --;
Line 61, “record” should read -- recording --; and
Line 66, “are” should read -- is --.

Column 3,
Line 58, “to” should be deleted;
Line 60, “pitch, and” should read -- pitch. --; and
Line 65, “And” should be deleted.

Column 4,
Line 9, “wounded” should read -- wound --;
Line 44, “multiplicity” should read -- plurality --; and
Line 60, “multiplicity” should read -- plurality --.

Column 5,
Line 10, “to” should be deleted;
Line 12, “with” should be deleted.

Column 6,
Line 1, “with” should be deleted.

Column 7,
Line 67, “to” should be deleted.

Column 8,
Line 22, “avoided of” should read -- prevented from --.

Column 10,
Line 7, “members” should read -- member --; and
Line 42, “cross” should read -- cross- --.

Column 13,
Line 61, “guide” should read -- guiding --; and
Line 65, “blow” should read -- blows --.

UNITED STATES PATENT AND TRADEMARK OFFICE

CERTIFICATE OF CORRECTION

PATENT NO. : 6,367,906 B1
DATED : April 9, 2002
INVENTOR(S) : Soichi Hiramatsu et al.

It is certified that error appears in the above-identified patent and that said Letters Patent is hereby corrected as shown below:

Column 15,
Line 60, “the” should read -- said --.

Column 16,
Line 3, “director” should read -- direction --;
Line 4, “director” should read -- direction --;
Line 19, “director” should read -- direction --;
Line 20, “director” should read -- direction --;
Line 41, “form” should read -- forms --;
Line 61, “forward” should read -- rear --; and
Line 63, “members” should read -- member --.

Column 17,
Line 18, “fan,” should read -- fan; --.

Column 18,
Line 4, “claim 10” should read -- claim 18, --; and
Line 7, “characteristic” should read -- characteristics --.

Signed and Sealed this

Twenty-ninth Day of October, 2002

*Attest:*

*Attesting Officer*

JAMES E. ROGAN
*Director of the United States Patent and Trademark Office*